US011285684B2

(12) United States Patent
Bourgeois et al.

(10) Patent No.: US 11,285,684 B2
(45) Date of Patent: Mar. 29, 2022

(54) METHOD AND DEVICE FOR CORRECTING THE FOLDED POSITION OF A BLANK IN A FOLDER-GLUER

(71) Applicant: BOBST MEX SA, Mex (CH)

(72) Inventors: Sacha Bourgeois, Bussigny (CH); Dimitri Favini, Villars-Bozon (CH)

(73) Assignee: BOBST MEX SA

( * ) Notice: Subject to any disclaimer, the term of this patent is extended or adjusted under 35 U.S.C. 154(b) by 488 days.

(21) Appl. No.: 15/528,578

(22) PCT Filed: Nov. 10, 2015

(86) PCT No.: PCT/EP2015/025079
§ 371 (c)(1),
(2) Date: May 22, 2017

(87) PCT Pub. No.: WO2016/082937
PCT Pub. Date: Jun. 2, 2016

(65) Prior Publication Data

US 2018/0339479 A1 Nov. 29, 2018

(30) Foreign Application Priority Data

Nov. 24, 2014 (EP) ..... 14020095

(51) Int. Cl.
*B31B 50/00* (2017.01)
*B31B 50/26* (2017.01)
(Continued)

(52) U.S. Cl.
CPC ..... *B31B 50/003* (2017.08); *B31B 50/00* (2017.08); *B31B 50/006* (2017.08);
(Continued)

(58) Field of Classification Search
CPC ..... B31B 50/003; B31B 50/006; B31B 50/00; B31B 50/07; B31B 50/044; B31B 50/26;
(Continued)

(56) References Cited

U.S. PATENT DOCUMENTS 2,887,022 A 5/1959 Lubersky
3,266,391 A * 8/1966 Lopez ..... B31B 50/00 493/438

(Continued)

FOREIGN PATENT DOCUMENTS

EP 0 937 573 A1 8/1999
EP 1 932 658 A1 6/2008

(Continued)

OTHER PUBLICATIONS

International Search Report mailed Feb. 1, 2016 in corresponding PCT International Application No. PCT/EP2015/025079.

(Continued)

*Primary Examiner* — Anna K Kinsaul
*Assistant Examiner* — Daniel Jeremy Leeds
(74) *Attorney, Agent, or Firm* — Ostrolenk Faber LLP

(57) ABSTRACT

A method for checking and correcting the position of a blank (10) that includes closing the folded right-hand and left-hand flaps (17, 18) of the blank, which are positioned one above the other in an overlapping portion, checking the position of the right-hand edge (13) and of the left-hand edge (14), and comparing the position with a predetermined position in order to determine a positional deviation, if the positional deviation exceeds an admissible deviation value, and before the glue sets, fixing of the central flap (19), then holding the upper face of the right-hand flap and of the left-hand flap by a suction cup (21, 23, 24, 26), and correcting the position of the left-hand flap (18) and/or of the right-hand flap (17) by moving the suction cup (21, 23, 24, 26).

8 Claims, 14 Drawing Sheets

Figure 2:
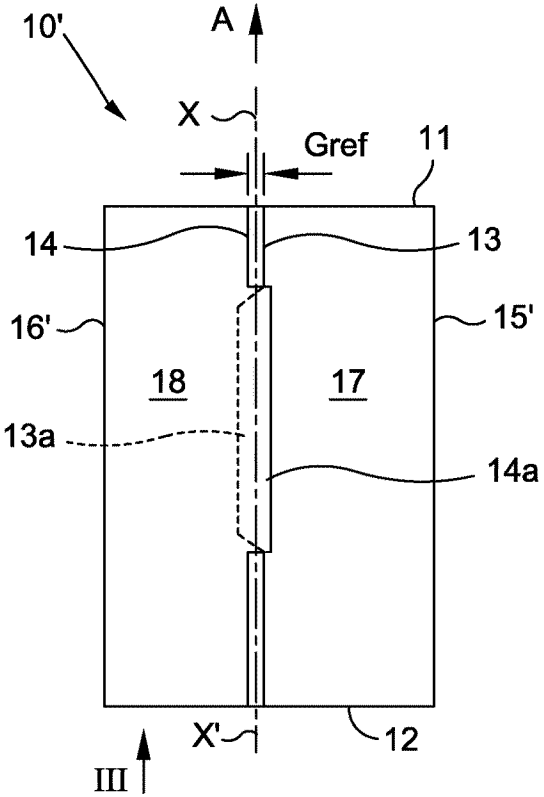

(51) Int. Cl.

| | |
|---|---|
| ***B31B 50/07*** | (2017.01) |
| ***B31B 50/04*** | (2017.01) |
| ***B31B 50/62*** | (2017.01) |
| ***B31B 100/00*** | (2017.01) |
| ***B31B 120/30*** | (2017.01) |
| ***B31B 110/35*** | (2017.01) |
| ***B31B 120/70*** | (2017.01) |

(52) U.S. Cl.
CPC ..... *B31B 50/044* (2017.08); *B31B 50/07* (2017.08); *B31B 50/26* (2017.08); *B31B 50/624* (2017.08); *B31B 2100/00* (2017.08); *B31B 2100/0022* (2017.08); *B31B 2110/35* (2017.08); *B31B 2120/30* (2017.08); *B31B 2120/302* (2017.08); *B31B 2120/70* (2017.08)

(58) Field of Classification Search
CPC ..... B31B 50/624; B31B 2120/30; B31B 2120/70; B31B 2120/302; B31B 2110/35; B31B 2100/00
See application file for complete search history.

(56) References Cited

U.S. PATENT DOCUMENTS

| | | | | | |
|---|---|---|---|---|---|
| 3,611,884 | A | | 10/1971 | Hottendorf | |
| 3,797,371 | A | * | 3/1974 | Randle | B31B 50/00 493/295 |
| 3,884,131 | A | | 5/1975 | Palsson | |
| 4,012,996 | A | | 3/1977 | Stolkin | |
| 4,319,878 | A | | 3/1982 | Dozier | |
| 4,614,512 | A | | 9/1986 | Capdeboscq | |
| 4,834,696 | A | | 5/1989 | Marschke | |
| 5,091,962 | A | | 2/1992 | Malloy | |
| 5,212,656 | A | * | 5/1993 | Clary | G01B 11/04 702/84 |
| 5,217,425 | A | | 6/1993 | Cantrell | |
| 5,230,686 | A | | 7/1993 | McAdam, III | |
| 5,683,338 | A | | 11/1997 | Krasuski | |
| 5,714,028 | A | | 2/1998 | Horai | |
| 5,980,440 | A | * | 11/1999 | Mitman | B31B 50/00 493/128 |
| 6,024,682 | A | | 2/2000 | Mandel | |
| 6,099,450 | A | | 8/2000 | Schenone | |
| 6,323,502 | B1 | * | 11/2001 | Battut | G01B 11/02 250/559.19 |
| 7,565,032 | B2 | | 7/2009 | Okai | |
| 7,569,007 | B2 | | 8/2009 | Thoma | |
| 7,770,876 | B2 | * | 8/2010 | Sasahara | B31F 1/08 270/20.1 |
| 7,856,798 | B2 | | 12/2010 | Schroeder | |
| 8,033,975 | B2 | | 10/2011 | Wiklund | |
| 8,073,239 | B1 | * | 12/2011 | Bahrami | G06T 7/001 382/141 |
| 8,480,550 | B2 | | 7/2013 | Taketsugu | |
| 8,579,777 | B2 | | 11/2013 | Hatano | |
| 2009/0280973 | A1 | * | 11/2009 | Graham | B65D 5/003 493/127 |
| 2010/0210436 | A1 | * | 8/2010 | Taketsugu | B65H 29/62 493/29 |
| 2012/0053032 | A1 | * | 3/2012 | Bruns | B31B 50/00 493/17 |
| 2013/0184133 | A1 | * | 7/2013 | Sugimoto | B65H 43/04 493/29 |
| 2013/0184134 | A1 | * | 7/2013 | Suzuki | B41F 33/0036 493/53 |
| 2015/0053349 | A1 | * | 2/2015 | Mori | B31F 1/2836 156/355 |
| 2017/0080665 | A1 | * | 3/2017 | Capoia | B31B 50/00 |
| 2017/0274612 | A1 | * | 9/2017 | Nadachi | B31B 50/54 |
| 2017/0293291 | A1 | * | 10/2017 | Diehr | G05B 19/41875 |
| 2018/0339479 | A1 | | 11/2018 | Bourgeois | |

FOREIGN PATENT DOCUMENTS

| | | | | |
|---|---|---|---|---|
| EP | 2 213 449 | A1 | 8/2010 | |
| FR | 2 721 301 | A1 | 12/1995 | |
| FR | 2721301 | A1 * | 12/1995 | B65H 45/26 |

OTHER PUBLICATIONS

Written Opinion mailed Feb. 1, 2016 in corresponding PCT International Application No. PCT/EP2015/025079.
International Search Report dated May 3, 2016 in corresponding PCT International Application No. PCT/EP2015/025080.
Written Opinion dated May 3, 2016 in corresponding PCT International Application No. PCT/EP2015/025080.

* cited by examiner

METHOD AND DEVICE FOR CORRECTING THE FOLDED POSITION OF A BLANK IN A FOLDER-GLUER

CROSS-REFERENCE TO RELATED APPLICATION

The present application is a 35 U.S.C. §§ 371 national phase conversion of PCT/EP2015/025079, filed Nov. 10, 2015, which claims priority of European Patent Application No. 14020095.7, filed Nov. 24, 2014, the contents of all of which are incorporated herein by reference. The PCT International Application was published in the French language.

TECHNICAL FIELD

The present invention relates to the field of packaging manufacture, and specifically packaging made from precut strips or sheets, in particular of paper, plastic or cardboard blanks, which may be flat, corrugated or mixed.

In particular, the present invention relates to the machine or module that takes a pre-creased cardboard blank and firstly folds the two lateral flaps down towards a central assembly line, with a partial overlap of the external edge of these flaps, and secondly glues these two flaps in the overlap zone to hold same in the folded position imposed by the machine. Such machines are referred to as folder-gluers.

PRIOR ART

Numerous machines in the prior art perform these combined folding-gluing operations along the route of the longitudinal axis of the folder-gluer. During these processing operations of each cardboard blank, the two flaps often suffer from positional deviations, from the desired position of same, once they have been folded and glued, either due to a deviation of the movable elements of the machine, and/or due to an offsetting of all or part of the blank in relation to the machine during processing of same and/or due to a blank having geometric properties that are slightly different from the ideal model of the cardboard blank.

When flat (see FIG. 1), a cardboard blank 10 has a generally rectangular shape with two longer sides forming the front edge 11 for the side that enters the folder-gluer machine first, and the rear edge 12 for the side that enters the folder-gluer machine last. When the blank is moving through the folder-gluer machine in the direction of the Arrow A, this front edge 11 and this rear edge 12, which are parallel to one another, are generally orthogonal to the longitudinal axis X-X' of the folder-gluer. The two shorter lateral sides form the right-hand edge 13 and the left-hand edge 14, which are parallel to one another and to the longitudinal axis X-X' of the folder-gluer. The right-hand edge 13 is the lateral side that is located to the right of the longitudinal axis of the folder-gluer, and the left-hand edge 14 is the lateral side that is located to the left of the longitudinal axis X-X' of the folder-gluer. The right-hand and left-hand edges 13, 14 include a cutout along the two end portions thereof to form a right-hand tab 13*a* and a left-hand tab 14*a* in the central portion of the right-hand and left-hand edges 13, 14. In some blanks, the right-hand tab 13*a* is absent, the edge 13 then being completely straight.

Two longitudinal dotted lines show the fold lines, formed by the right-hand longitudinal crease 15 and the left-hand longitudinal crease 16, which delimit the central flap 19. The right-hand flap 17 is located between the right-hand crease 15 and the right-hand edge 13. The left-hand flap 18 is located between the left-hand longitudinal crease 16 and the left-hand edge 14.

Figure 3:
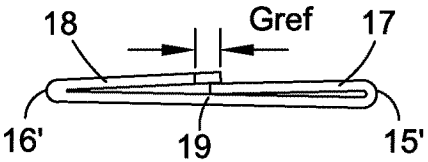

FIGS. 2 and 3 shows the blank 10 after the two flaps 17 and 18 have been folded down onto one another, and after the right-hand tab 13*a* and the left-hand tab 14*a* have been glued together in an ideal conformation. In alternative blanks, the right-hand tab 14*a* is glued directly to the edge 13 of the flap 17. In this situation, the right-hand side 15' of the folded-glued blank 10' is obtained at the position of the right-hand longitudinal crease 15, and the left-hand side 16' of the folded-glued blank 10' is obtained at the position of the left-hand longitudinal crease 16. In this case (see more specifically FIG. 2), the right-hand edge 13 and the left-hand edge 14 are separated from one another, at the level of the cutouts, by a gap Gréf, forming a reference gap of predetermined value that is constant along the length of the cutouts. Consequently, in FIG. 2, the same value Gréf can be found at the position of the front edge 11 and at the position of the rear edge 12.

Figure 4:
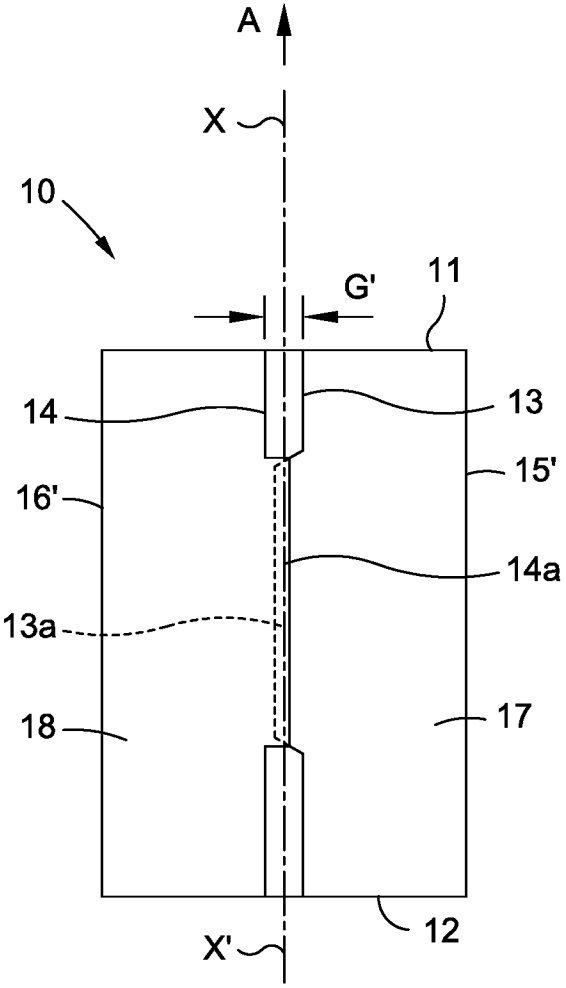

Two main positioning anomalies of the two lateral flaps 17 and 18 can in particular be identified. A first positioning anomaly of the two lateral flaps, referred to as a gap, corresponds to an excessively large gap between the right-hand and left-hand edges 13, 14 of the two folded and glued flaps 17, 18: this first anomaly is shown in FIG. 4, with a gap G' forming a gap that is larger than Gréf.

Figure 6:
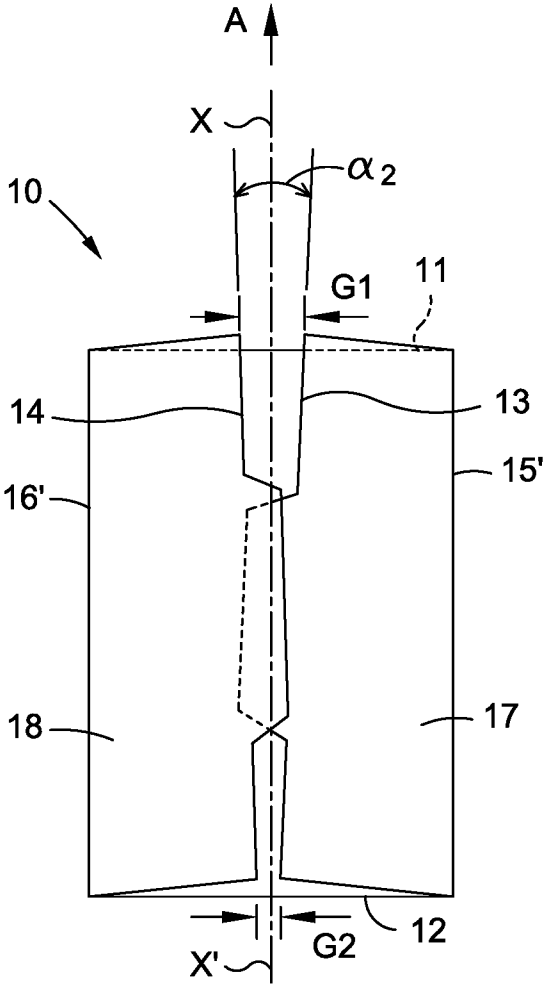
Figure 5:
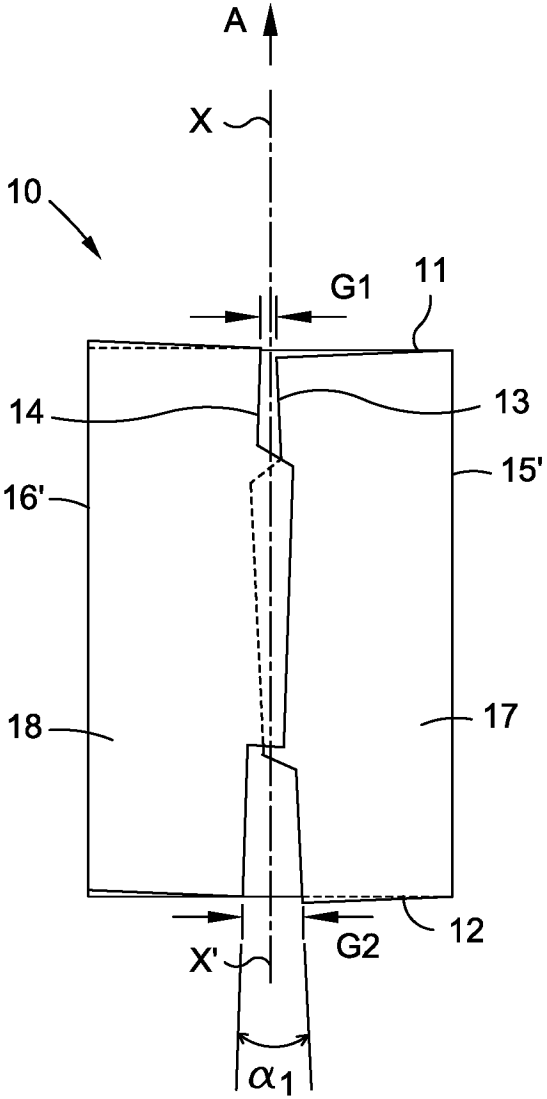

A second positioning anomaly of the two lateral flaps 17, 18, referred to as fishtailing, is a paralleling fault between the edges 13 and 14 of the two folded and glued lateral flaps 17, 18, usually accompanied by the same paralleling faults between the sides 15' and 16'. A first arrangement of this second anomaly is shown in FIG. 5: in this case, the edges 13 and 14 are convergent in the direction of the front edge 11 such that they form a gap G1 between the front ends of the edges 13 and 14 that is smaller (and potentially negative) than the gap G2 between the rear ends of the edges 13 and 14. In this case of rear fishtailing or open fishtailing, an angle $\alpha 1$ between the edges 13 and 14 is measured from the rear edge 12. A second arrangement of this second anomaly is shown in FIG. 6: in this case the edges 13 and 14 are divergent in the direction of the front edge 11 and convergent in the direction of the rear edge 12, such that they define a gap G1 between the front ends of the edges 13 and 14 that is larger (and potentially negative) than the gap G2 between the rear ends of the edges 13 and 14. In this case of front fishtailing or closed fishtailing, an angle $\alpha 2$ between the edges 13 and 14 is measured from the front edge 11. Of course, these two gap and fishtailing anomalies can be found simultaneously on a single cardboard blank.

Document EP 1932658 describes a method and a folder-gluer machine that uses, in two successive alignment modules, an alignment rule oriented adjustably in relation to the longitudinal direction of the machine such that it enables, by means of this angular offsetting applied to one and then the other of the sides of the folded blank, at least a portion of the alignment fault between the right-hand and left-hand edges 13, 14 to be corrected. However, this solution makes it possible to systematically correct the portion of the alignment fault caused by mechanical movements of the machine and not by the shape or the reaction to folding or other processes specific to each cardboard blank.

In the machines in the prior art, position sensors detect these anomalies after the blank is processed to identify and eject packaging with anomalies that exceed a predetermined dimensional tolerance threshold. Moreover, in the machines in the prior art, the anomalies identified are systematically corrected by modifying the settings of the movable parts of the machine, but do not take account of the deformation of the blank caused specifically by the incorrect positioning of same in the machine, incorrect folding, incorrect cutting (contour) or even incorrect creasing.

SUMMARY OF THE INVENTION

One objective of the present invention is to propose a method and a device for processing a blank in a folder-gluer that enables the position of the right-hand and left-hand flaps to be corrected once they have been folded onto one another, without the limitations of known machines. Another objective is to provide a method and a device that enables the folded position of the right-hand flap and/or of the left-hand flap of a blank to be corrected in consideration of the individual situation of each blank. Another objective is to enable the folded position of the right-hand flap and/or of the left-hand flap of a blank to be corrected or otherwise, on a case-by-case basis, to obtain admissible blanks in most cases. Consequently, a maximum number of blanks can be kept for subsequent processing, with only a limited number of blanks being discarded. This results in material savings since only a few blanks are ejected from the machine to be discarded.

According to the invention, these objectives are achieved in particular by means of a method for processing a blank intended to form, after folding-gluing, a folded flattened box, comprising the following steps:

a) providing a substantially flat blank having a right-hand edge, a left-hand edge, a front edge, a rear edge, a right-hand longitudinal crease and a left-hand longitudinal crease, the right-hand longitudinal crease and the left-hand longitudinal crease delimiting, with the right-hand edge and the left-hand edge, at least three flaps including a right-hand flap, a left-hand flap and a central flap, b) applying of glue to a zone of the right-hand flap adjacent to the right-hand edge and/or to a zone of the left-hand flap adjacent to the left-hand edge, such that the glue is present in an overlapping portion between the right-hand flap and the left-hand flap, c) 180° folding of the right-hand flap about the right-hand longitudinal crease towards the central flap, and 180° folding of the left-hand flap about the left-hand longitudinal crease towards the central flap, d) closing the folded right-hand flap and of the folded left-hand flap that are positioned one above the other at least in the overlapping portion, e) checking the folded position of the right-hand edge and of the left-hand edge and comparison of this actual position with a predetermined position in order to determine a positional deviation, f) if the positional deviation exceeds an admissible deviation value, implementing the following sub-steps before the glue sets:

f1) fixing the central flap, then f2) holding the upper face of the folded right-hand flap and of the folded left-hand flap respectively by at least one suction cup with vacuum, f3) correcting the position of the left-hand flap and/or of the right-hand flap by moving the suction cup with vacuum, g) pressing between the right-hand flap and the left-hand flap in the overlapping portion until the glue sets, and h) releasing of the central flap, of the right-hand flap and of the left-hand flap.

The use of partially vacuumized suction cups makes it possible to hold then correct the position of the folded right-hand flap and/or of the folded left-hand flap, without causing any damage.

This solution has been notable advantage over the prior art of correcting the position of the folded flaps only if the positional check reveals that this is necessary, and that the correction is adapted to the specific geometric position of each individual blank.

Such a method can be used when the position of the blank, in the longitudinal direction of the folder-gluer, is substantially the same throughout the correction procedure. According to another embodiment, the method is implemented while the blank is moving in the longitudinal direction of the folder-gluer, either continuously or intermittently.

According to one embodiment, the fixing of the central flap during step f1) is realized via the lower face of same using fixing means using vacuum-induced negative pressing of the lower face. In this way, the central flap is held in a manner not damaging the blank and it is easy to activate or stop this rapidly.

According to the invention, these objectives are also achieved in particular using a device for correcting the position of a blank in a folder-gluer, for a substantially flat blank having a right-hand edge, a left-hand edge, a front edge, a rear edge, a right-hand longitudinal crease and a left-hand longitudinal crease, the right-hand longitudinal crease and the left-hand longitudinal crease delimiting, with the right-hand edge and the left-hand edge, at least three flaps including a right-hand flap, a left-hand flap and a central flap, the device comprising:

means for folding the right-hand flap and the left-hand flap, means for checking the relative position between the right-hand edge and the left-hand edge in the transverse direction after folding the right-hand flap and the left-hand flap, means for fixing the central flap, gluing means able to apply glue to a zone of the right-hand flap adjacent to the right-hand edge and/or to a zone of the left-hand flap adjacent to the left-hand edge, such that the glue is present in an overlapping portion between the right-hand flap and the left-hand flap, correction means including at least one suction cup designed to hold the right-hand flap and at least one suction cup designed to hold the left-hand flap, the suction cups being oriented downwards, movable vertically and transversely, and able to be vacuumized, and pressing means used to create a pressing contact between the right-hand flap and the left-hand flap in the overlapping portion.

Such a device makes it possible to simultaneously fold, from the top, the right-hand flap and the left-hand flap above the central flap, to fold down the folded right-hand flap and the folded left-hand flap, which are positioned one above the other at least in an overlapping portion, to apply the glue, to check the position of the right-hand and left-hand flaps, to correct the position of the right-hand flap, of the left-hand flap or of the right-hand flap and of the left-hand flap simultaneously if necessary, and to hold the corrected position while the right-hand flap and the left-hand flap are being held together in the overlapping portion until the glue sets. The order of the operations mentioned above is not fixed, and the glue may be applied before or after folding, before or after the positional check, or even before or after any correction applied.

The present invention also relates to a folder-gluer machine fitted with a correction device as described in this text.

SHORT DESCRIPTION OF THE FIGURES

Figure 1:
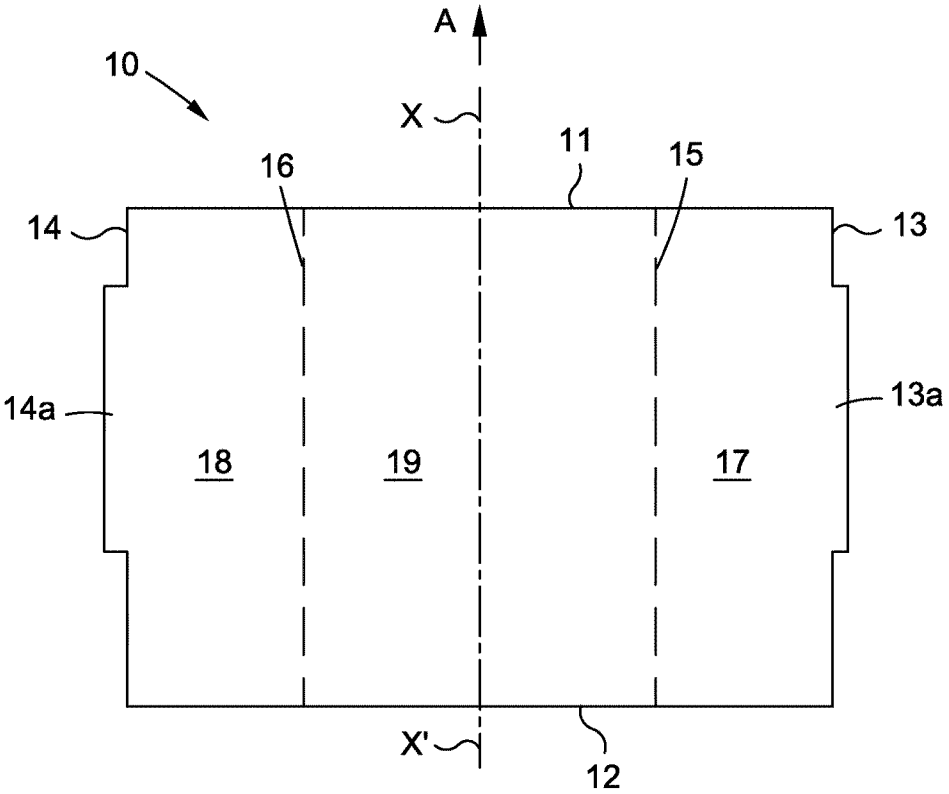
Figure 9:
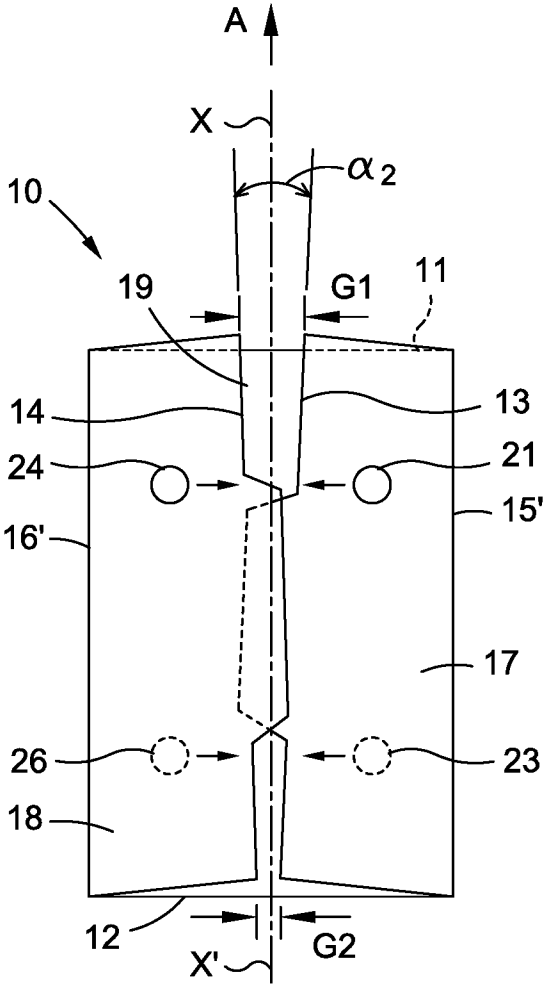
Figure 8:
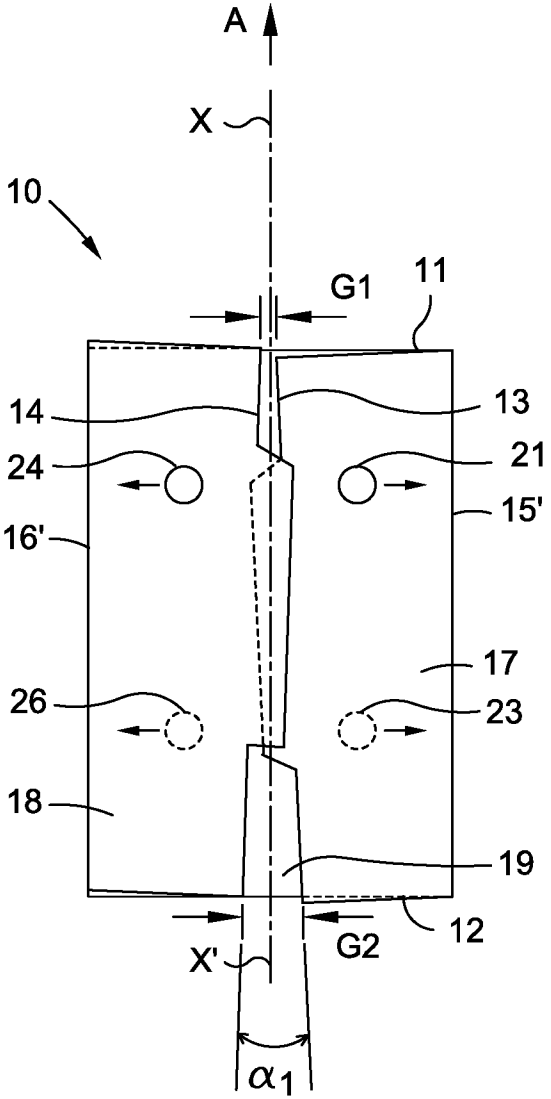
Figure 7:
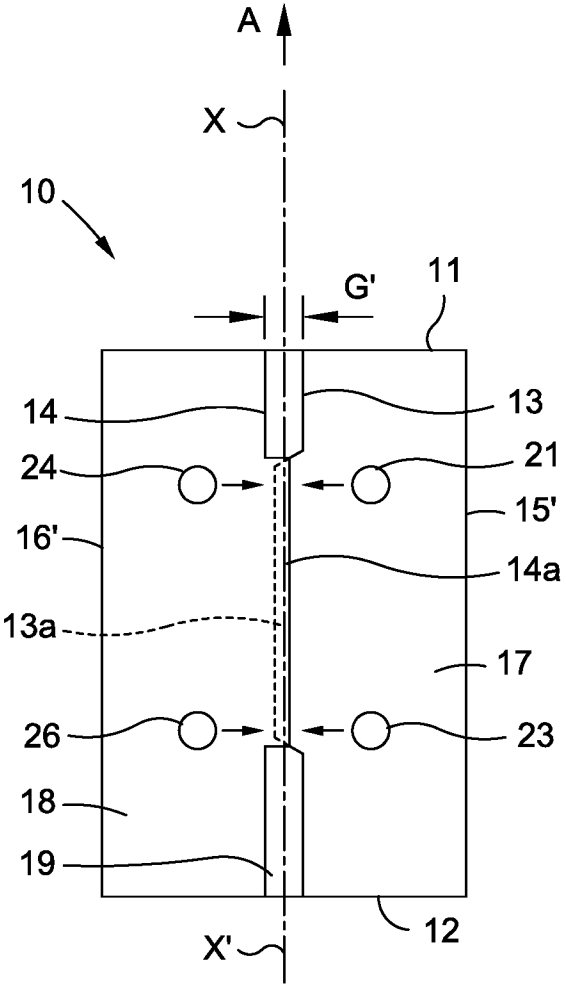
Figure 10A:
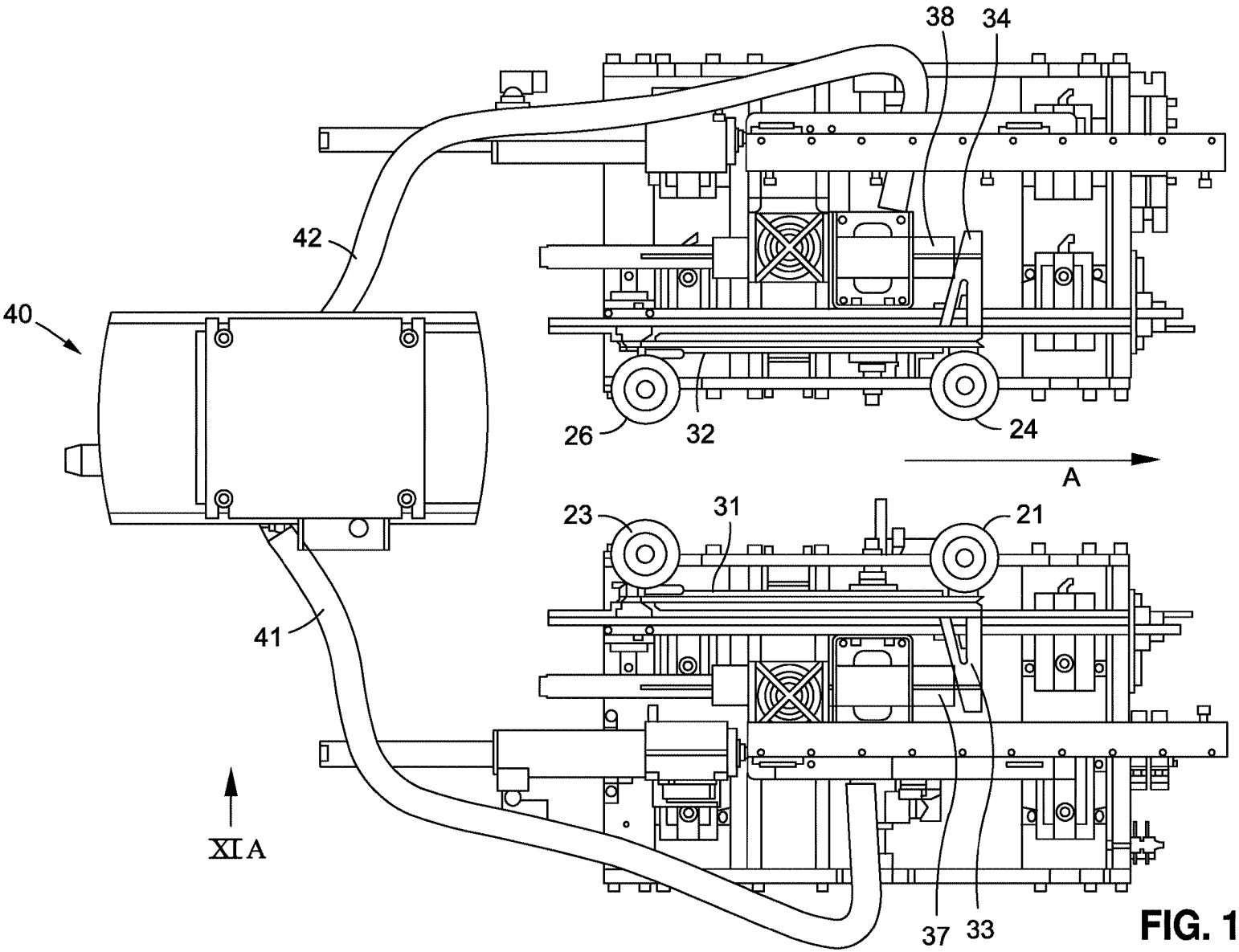
Figure 10B:
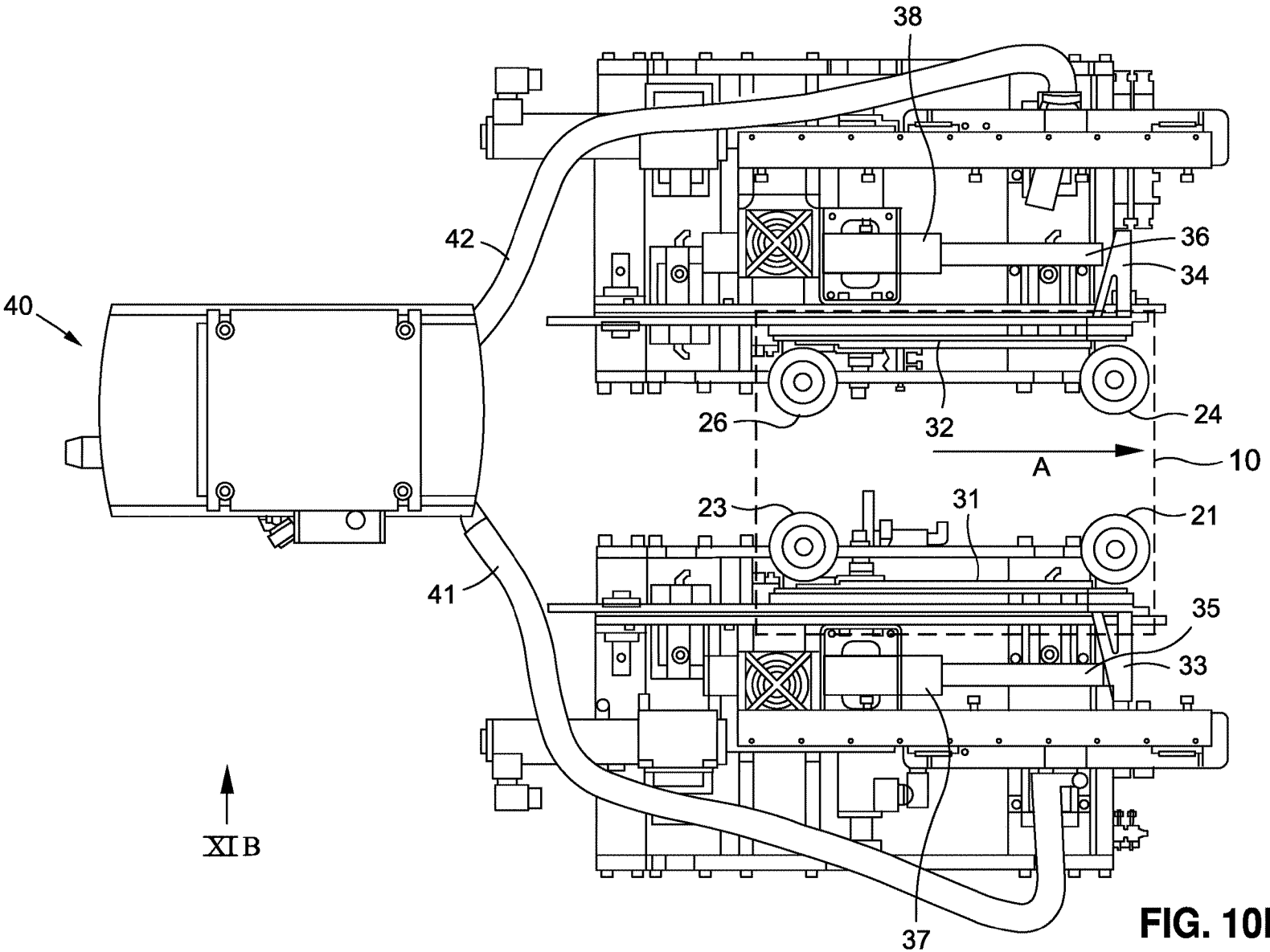
Figure 11A:
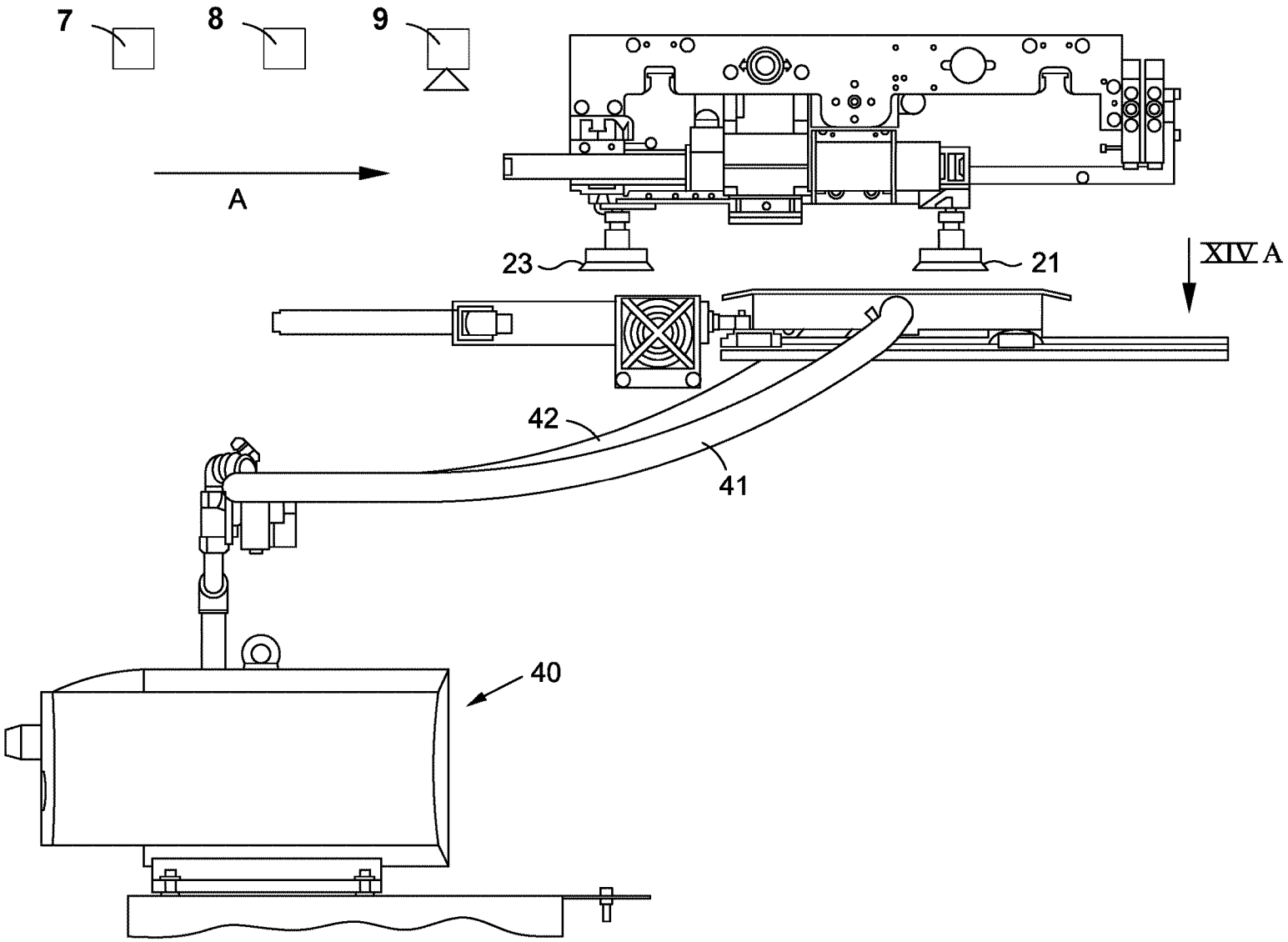
Figure 11B:
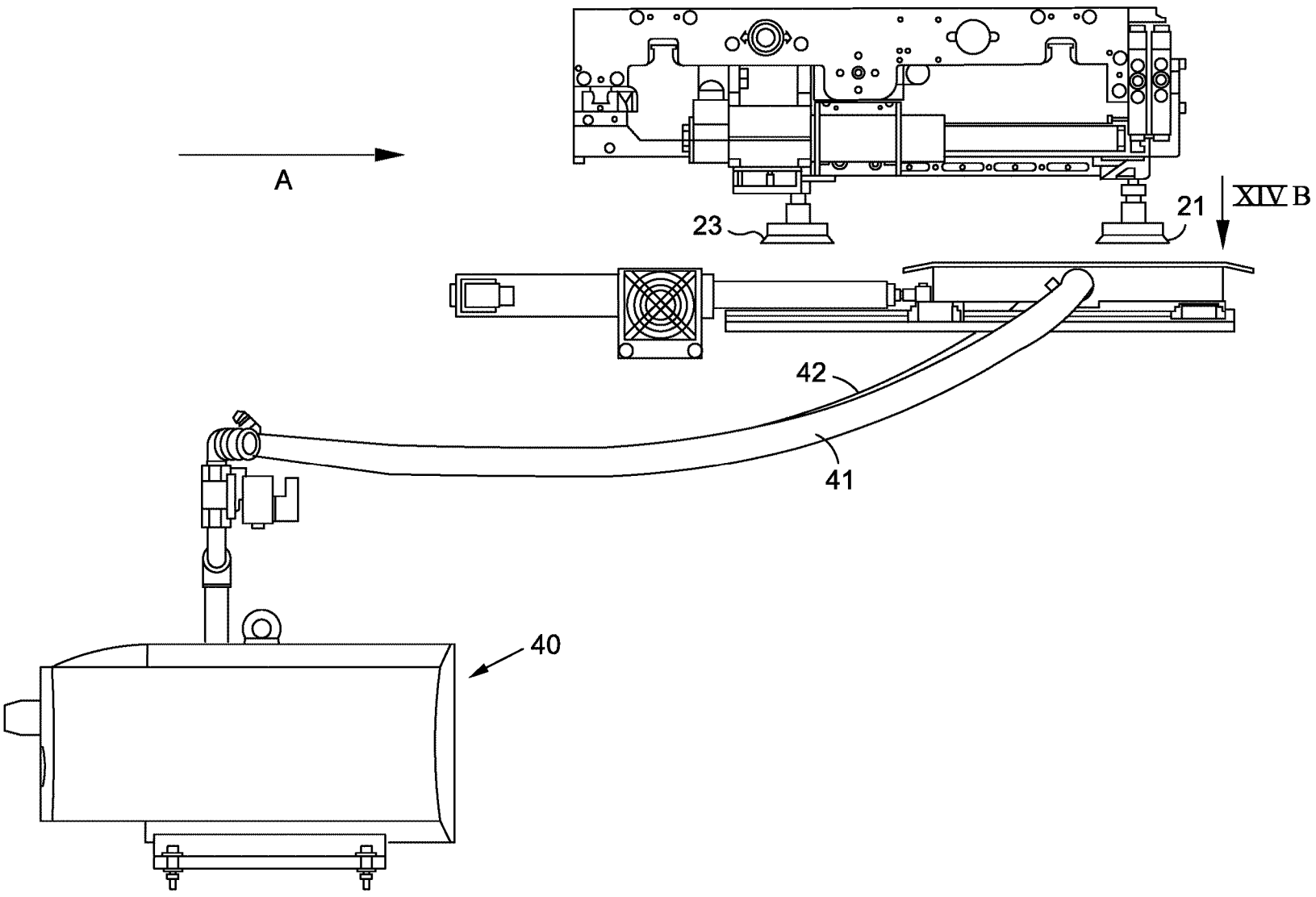
Figure 12:
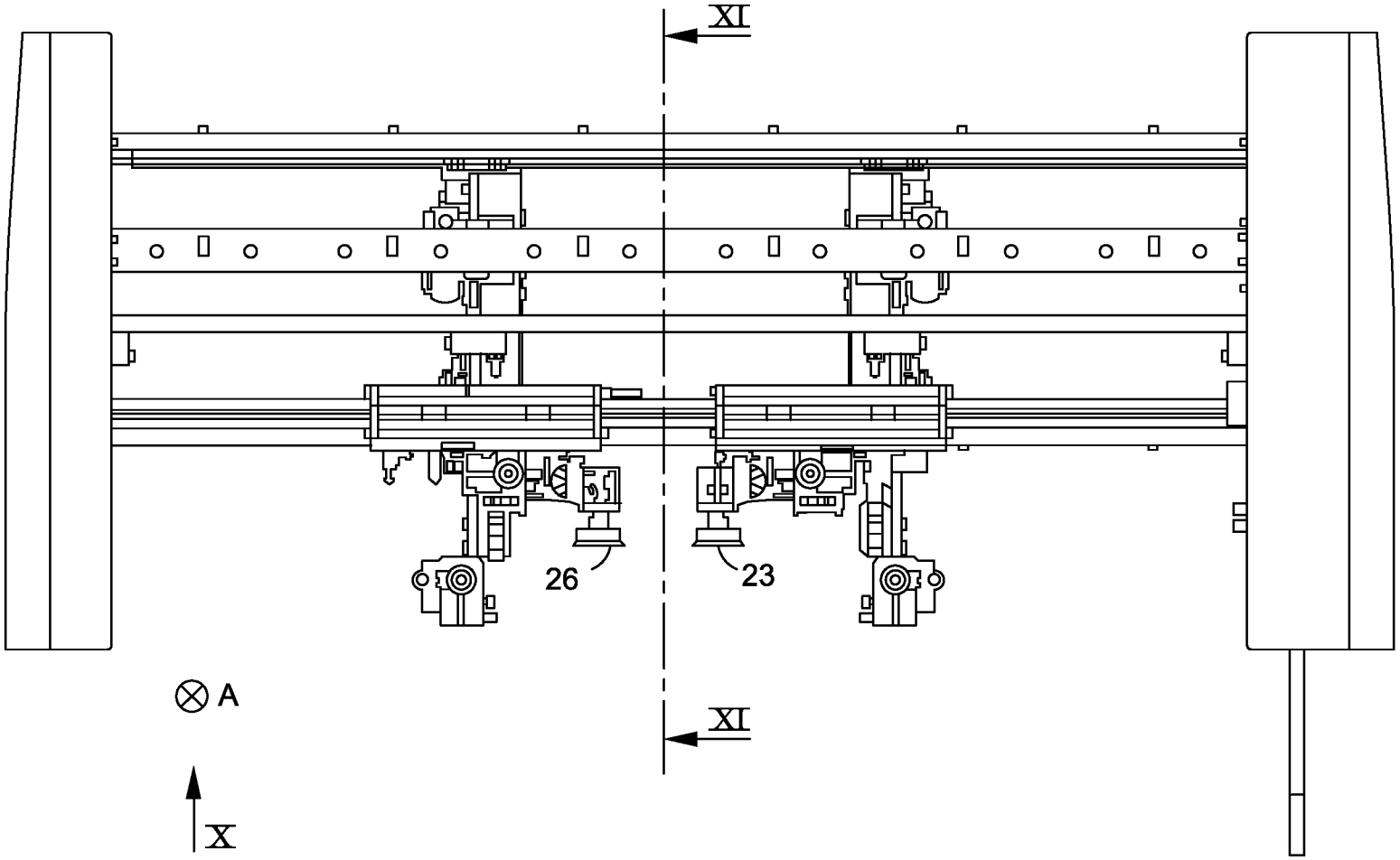
Figure 13:
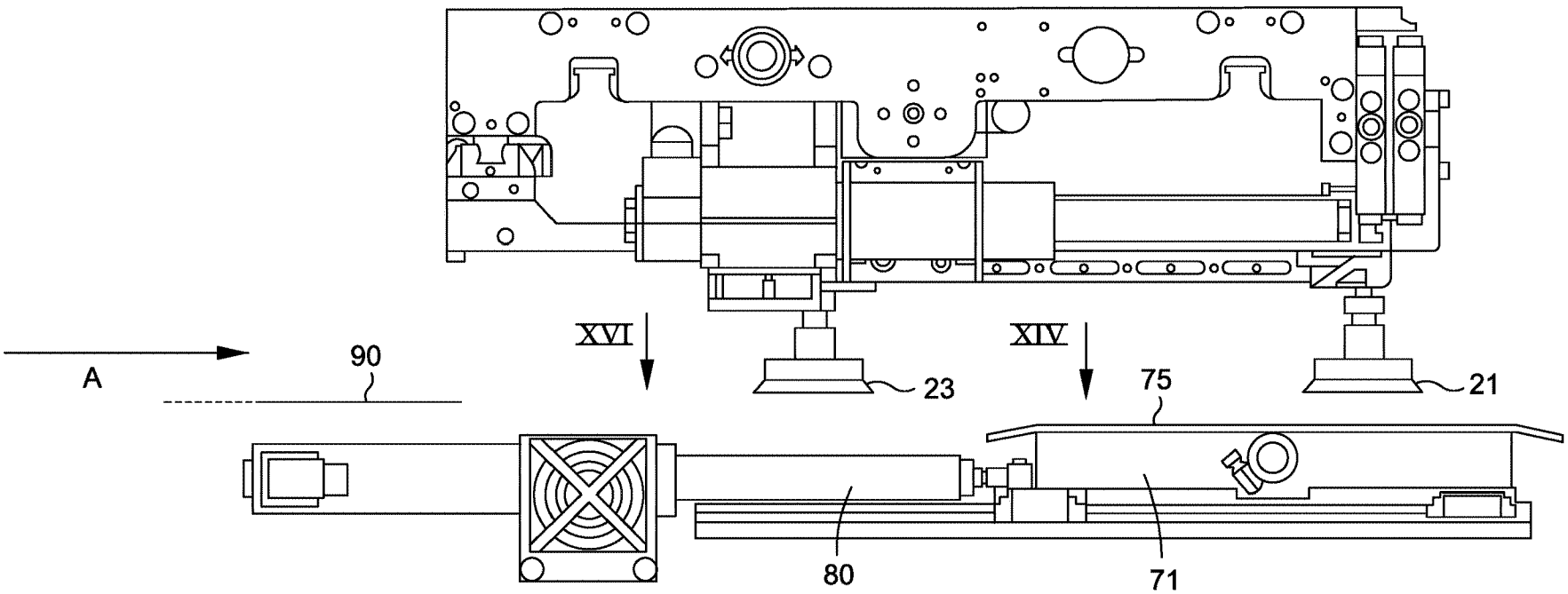
Figure 14:
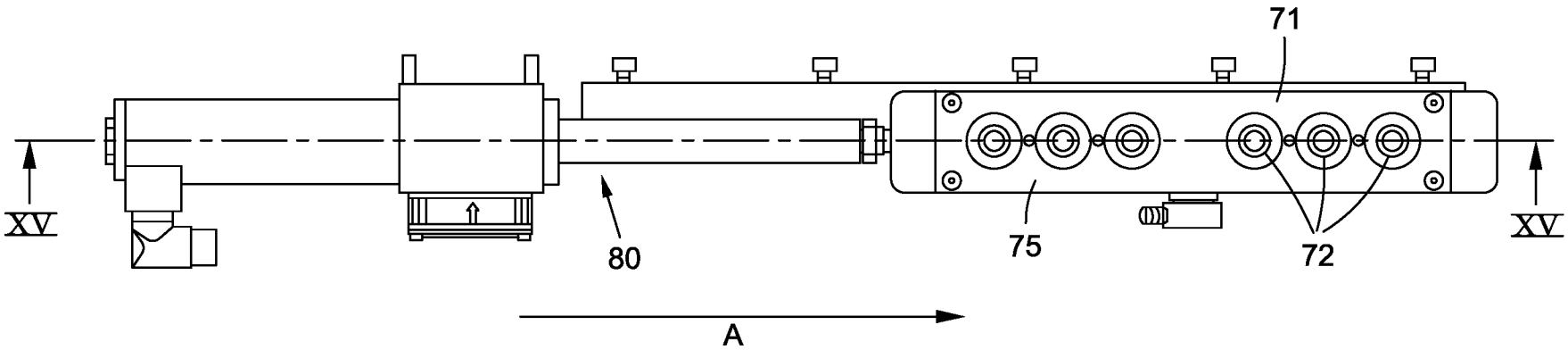
Figure 15:
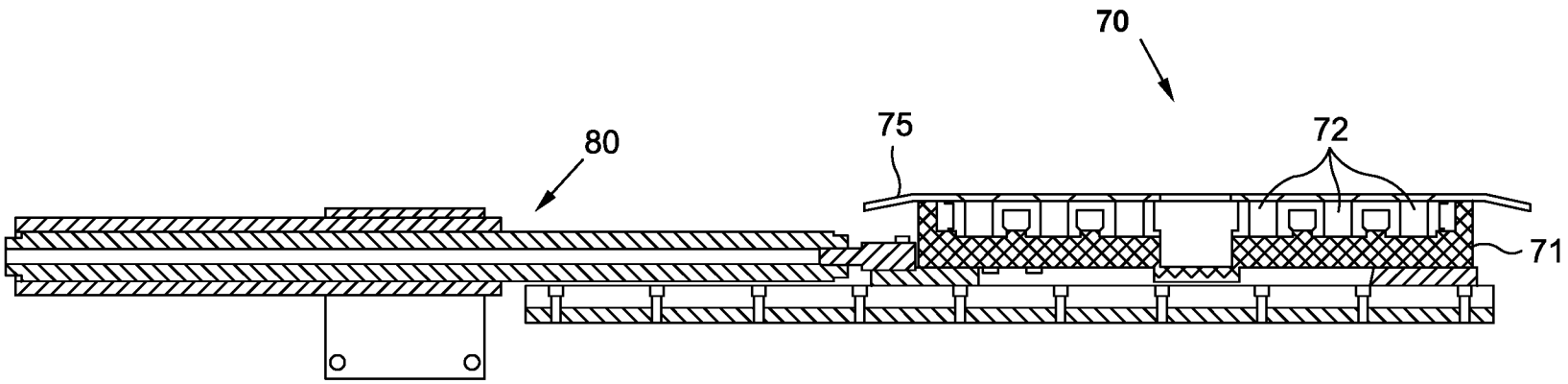
Figure 16A:
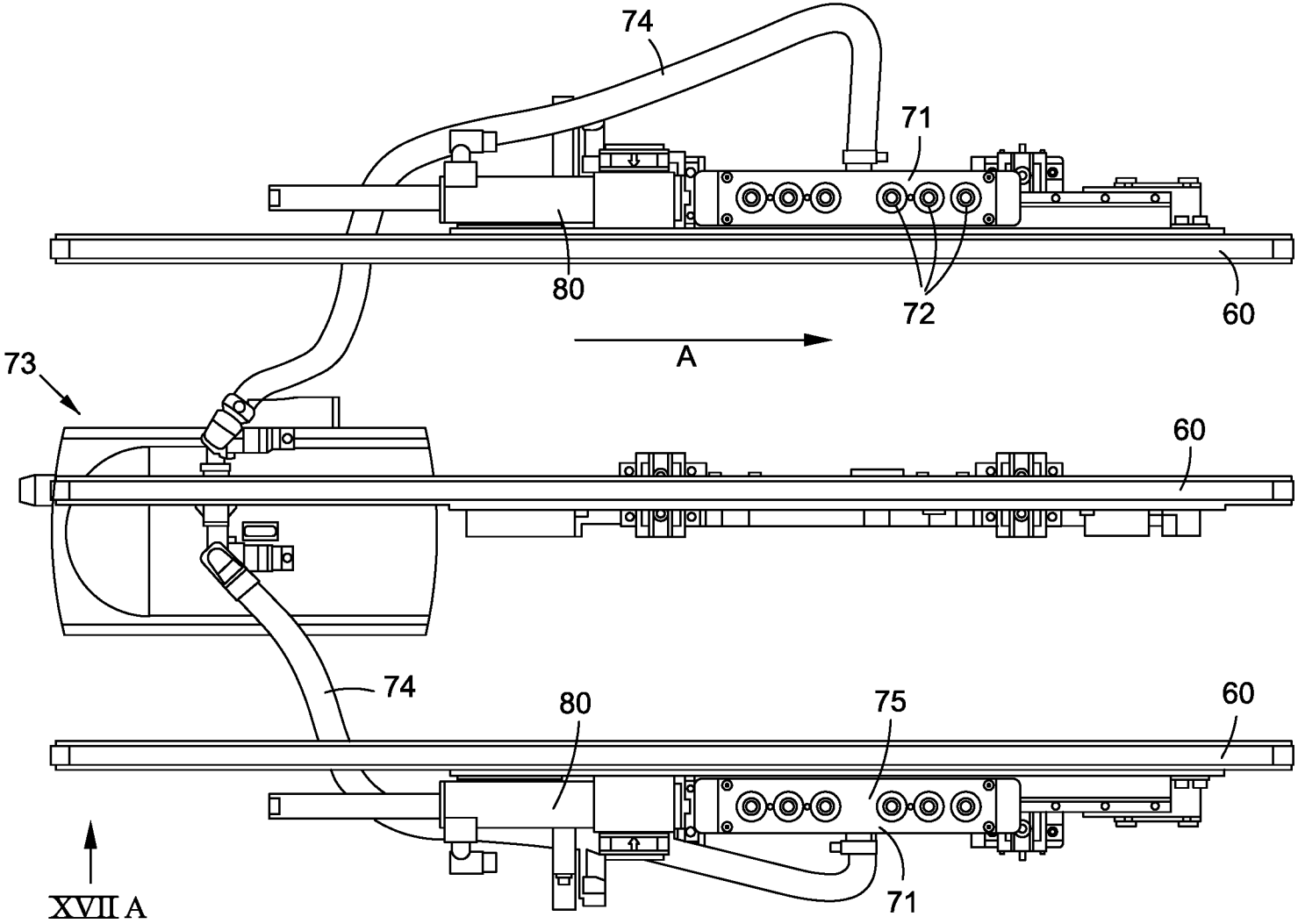
Figure 16B:
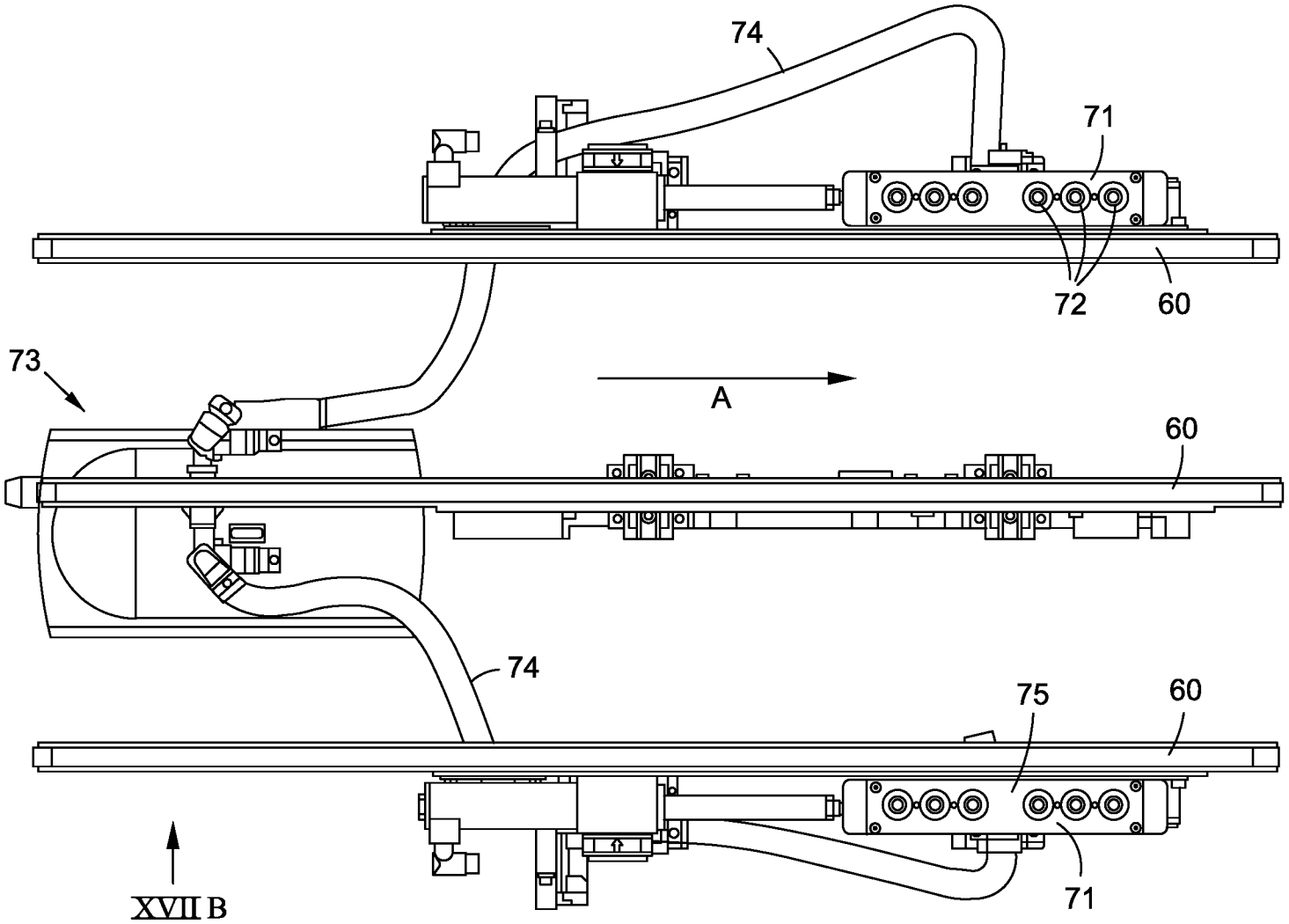
Figure 17A:
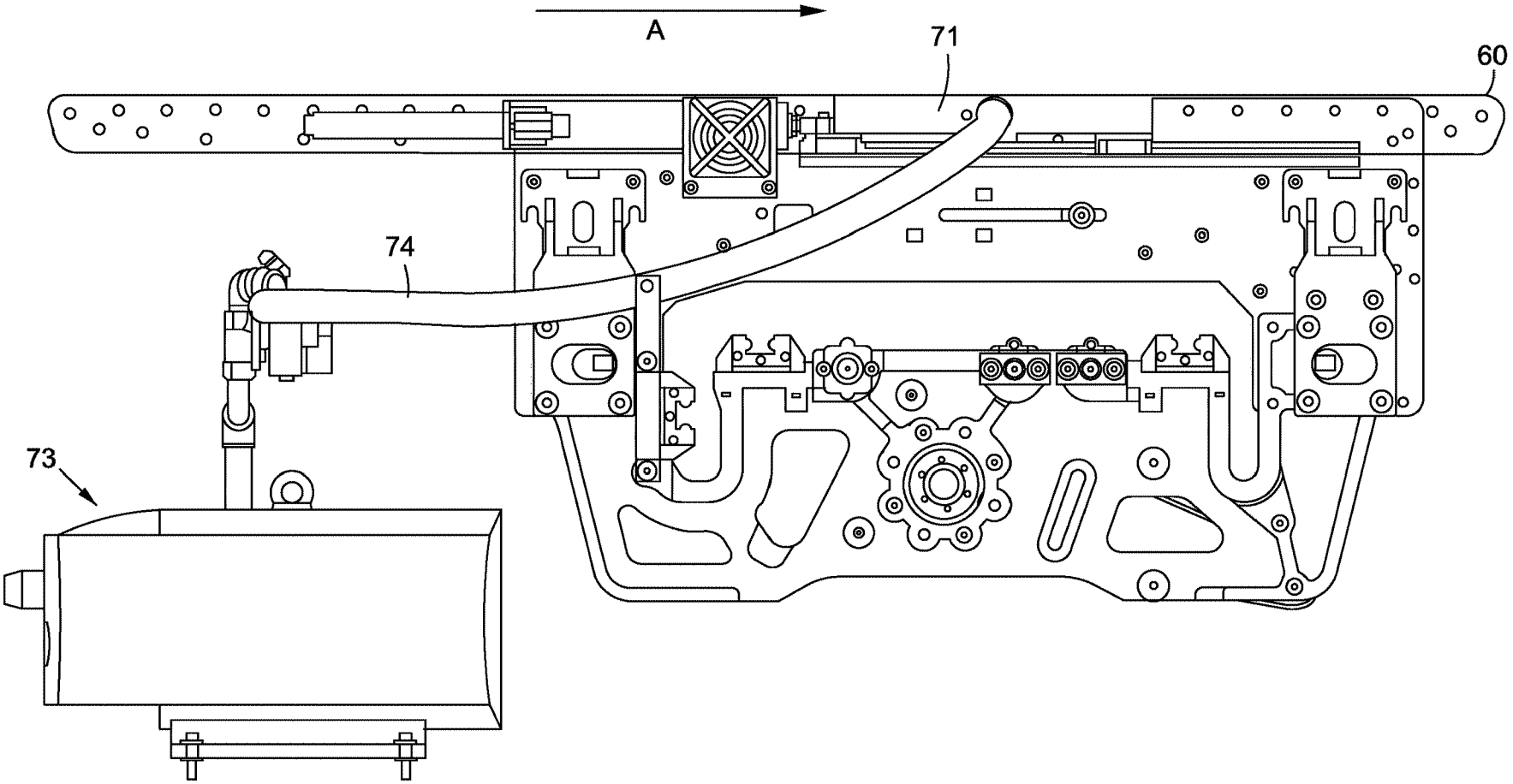
Figure 17B:
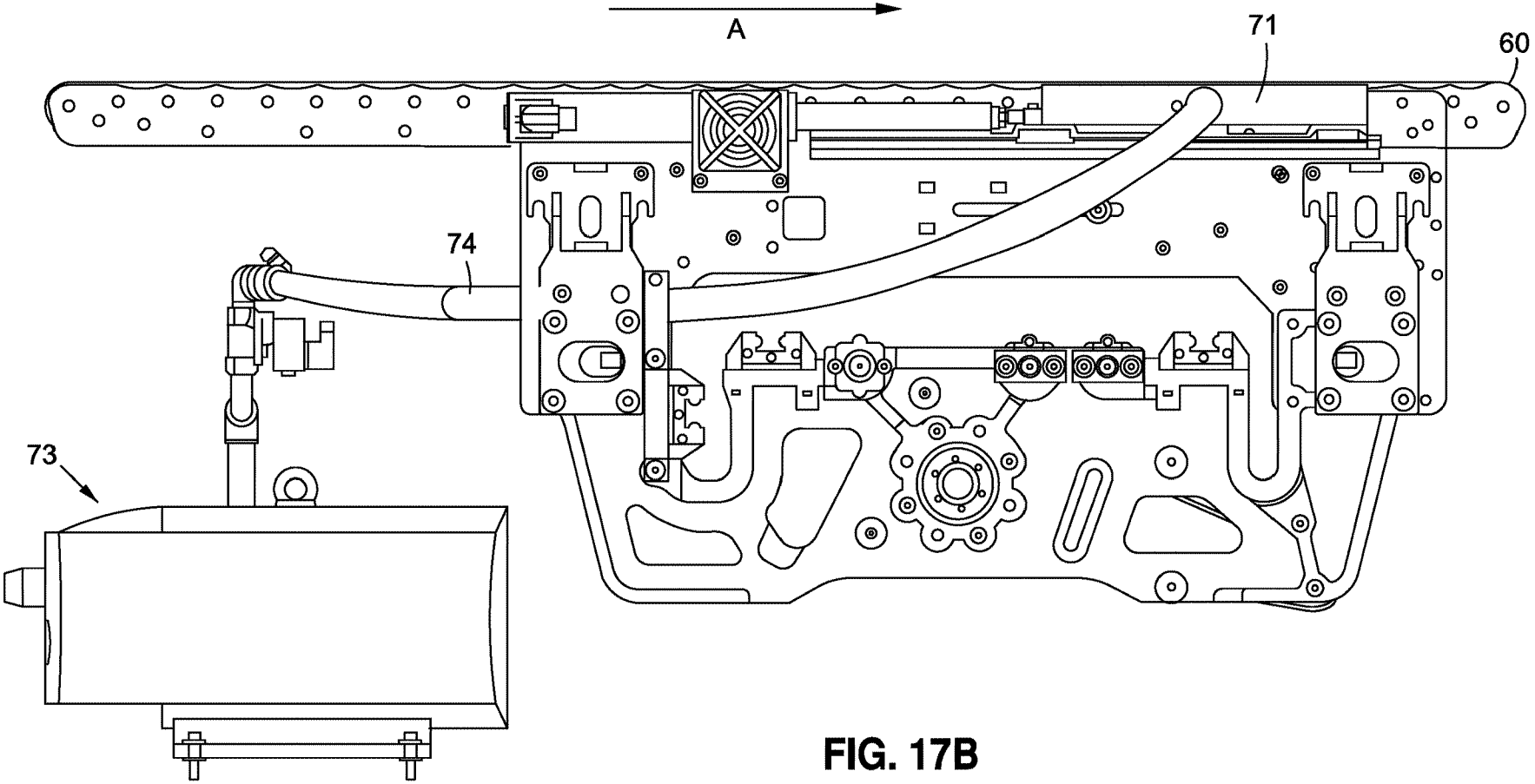

Example embodiments of the invention are given in the description, which is illustrated by the attached figures, in which:

FIG. 1 is a projection of a cardboard blank,

FIGS. 2 and 3 show this cardboard blank after the lateral flaps have been folded, respectively from above and from the front in the direction III shown in FIG. 2, FIGS. 4, 5 and 6 are similar to FIG. 2 and show arrangements with different folding anomalies, FIGS. 7, 8 and 9 show the correction method according to the method of the invention, respectively for the folding anomalies in FIGS. 4, 5 and 6, FIGS. 10A and 10B show, respectively for a first position and for a second position, a bottom view of an embodiment of the correction device according to the present invention, FIGS. 11A and 11B show, respectively for the first position and for the second position, a partial side view of the embodiment of the correction device according to the present invention, respectively in the direction XIA in FIG. 10A and in the direction XB in FIG. 10B, FIG. 12 shows a view in the direction XII in FIG. 11, showing the upper part of the correction device in FIG. 10 from below, FIG. 13 is a partial side view of the embodiment of the correction device according to the present invention, FIG. 14 shows a view in the direction XIV in FIG. 13, showing a portion of the lower part of the correction device in FIG. 13 from above, FIG. 15 is a cross-sectional view in the direction XV-XV in FIG. 14, FIGS. 16A and 16B show, respectively for the first position and for the second position, a top view in the direction XVI in FIG. 13, showing from above another portion of the lower portion of the correction device in FIG. 13, and FIGS. 17A and 17B show, respectively for the first position and for the second position, a side view in the direction XVII in FIG. 13, showing from the side the lower portion of the correction device in FIG. 13.

EXAMPLE EMBODIMENTS OF THE INVENTION

FIG. 7 shows the principle of the method for correcting an excessively large gap, specifically G'-Gréf>0. Consequently, in this case and following 180° folding of the right-hand flap 17 and of the left-hand flap 18, for example, by flap folder/means for folding 7, if a positional deviation is detected, i.e. the distance between the right-hand edge and the left-hand edge or the gap is outside the admissible range, as for the gap G' in FIG. 4 or FIG. 7, the following procedure is followed. Following fixing of the central flap 19, the upper face of the folded right-hand flap 17 and the upper face of the folded left-hand flap 18 are held simultaneously and respectively by two suction cups 21, 23 offset in a longitudinal direction and by two suction cups 24, 26 offset in the longitudinal direction.

For this purpose, the four suction cups 21, 23, 24 and 26 are lowered until they come into contact with the upward oriented face of the folded right-hand flap 17 and with the upward oriented face of the folded left-hand flap 18. The four suction cups 21, 23, 24 and 26 are vacuumized and securely hold the right-hand flap 17 at two points and the left-hand flap 18 at two points. Subsequently, as a function of the value of the lateral positional deviation (G'-Gréf) between the right-hand edge 13 and the left-hand edge 14, and any need to center this gap on a longitudinal midline of the blank (superposed on the axis X-X'), as identified by a positional check of the right-hand and left-hand edges 13, 14, the right-hand flap 17 or the left-hand flap 18 or both the right-hand flap 17 and the left-hand flap 18 will be moved laterally by moving some or all of the suction cups 21, 23, 24 and 26.

To do so, the position of the left-hand flap 18 and/or of the right-hand flap 16 is corrected by the sideways movement of the two suction cups 21, 23 of the right-hand flap 16 and/or of the two suction cups 24, 26 of the left-hand flap 18, in order to adjust the distance between the right-hand edge 13 and the left-hand edge 14 to bring same within the admissible range.

In a preferred embodiment, the two right-hand suction cups 21 and 23, including the front right-hand suction cup 21 and the rear right-hand suction cup 23, are moved jointly. Thus, in FIG. 7, to move the right-hand edge 13 towards the axis X-X', the pair of right-hand suction cups 21, 23 is moved towards the left. Equally and preferably, the two left-hand suction cups 24 and 26, including the front left-hand suction cup 24 and the rear left-hand suction cup 26, are moved jointly. Thus, in FIG. 7, to move the left-hand edge 14 towards the axis X-X', the pair of left-hand suction cups 24, 26 is moved towards the right.

FIGS. 8 and 9 show respectively the principle of the method for correcting rear fishtailing or front fishtailing. Thus, in this case and following 180° folding of the right-hand flap 17 and of the left-hand flap 18, if a positional deviation is detected, for example, by position checker/optical detector 9, in the form of a paralleling fault between the right-hand edge 13 and the left-hand edge 14, with an angular value $\alpha 1$ or $\alpha 2$ exceeding a maximum admissible value, this folding does not fall within the permissible range and, as for FIGS. 5 and 6, the following procedure is followed.

Following fixing of the central flap 19, the following is carried out simultaneously:

holding the upper face of the folded right-hand flap 17 by a single front or rear right-hand suction cup 21, 23 (the front right-hand suction cup 21 in FIGS. 8 and 9 in which the rear right-hand suction cup 23 is represented using a dotted line since it is not vacuumized and is therefore not holding the back of the right-hand flap 17), and holding the upper face of the folded left-hand flap 18 by a single front or rear left-hand suction cup 24, 28 (the front left-hand suction cup 24 in FIGS. 8 and 9 in which the rear left-hand suction cup 26 is represented using a dotted line since it is not vacuumized and is therefore not holding the back of the right-hand flap 17).

For this purpose, the four suction cups 21, 23, 24 and 26 are lowered in right- or left-hand pairs until they come into contact with the upward oriented face of the folded right-hand flap 17 and with the upward oriented face of the folded left-hand flap 18. In the example illustrated, only the front suction cup 21 and 24 of each pair is vacuumized. Consequently, holding results in the right-hand flap 17 being held securely at a single point (in this case at the front) and the left-hand flap 18 being held securely at a single point (in this case at the front). Subsequently, as a function of the value of the lateral positional deviation between the right-hand edge 13 and the left-hand edge 14 (identified in this case as G1-Gréf at the front and G2-GRéf at the rear, with the angle α1 or α2 measured between the right-hand edge 13 and the left-hand edge 14 possibly being taken into account), and any need to center this gap on a longitudinal midline of the blank (superposed on the axis X-X'), as identified by a positional check of the right-hand and left-hand edges 13, 14, the right-hand flap 17 or the left-hand flap 18 or both the right-hand flap 17 and the left-hand flap 18 simultaneously are moved by moving one or both of the front suction cups 21 and/or 24 sideways. Alternatively, in a correction method not shown, this angular movement is obtained by moving one or both of the rear suction cups 23 and/or 26 sideways.

Thus, in FIG. 8, the rear fishtailing is corrected by a sideways movement of the front suction cups 21 and 24 towards the external lateral sides of the folded blank 10, which are located on the same flap as the suction cup. Consequently, as shown in FIG. 8, the front right-hand suction cup 21 is moved towards the right-hand side 15', i.e. towards the right, and the front left-hand suction cup 24 is moved towards the left-hand side 16', i.e. towards the left.

In FIG. 9, the front fishtailing is corrected by a sideways movement of the front suction cups 21 and 24 towards the external lateral sides of the folded blank 10, which are located on the flap that is not the flap with the related suction cup. Consequently, as shown in FIG. 9, the front right-hand suction cup 21 is moved towards the left-hand side 16', i.e. towards the left, and the front left-hand suction cup 24 is moved towards the right-hand side 15', i.e. towards the right.

Consequently, if the positional deviation detected is a non-paralleling fault between the right-hand edge 13 and the left-hand edge 14, the angular position of the left-hand flap 18 and/or of the right-hand flap 16 is corrected using, for the right-hand flap 16 and for the left-hand flap 18, a single suction cup that is vacuumized to hold the corresponding flap, and which remains vacuumized during the sideways movement of same, as a result of which the orientation of the right-hand flap 17 and/or of the left-hand flap 18 is altered to bring the right-hand edge 13 and the left-hand edge 14 substantially parallel to one another.

This action to change the angular position of the right-hand flap 17 or of the left-hand flap 18 or of the right-hand flap 17 and of the left-hand flap 18 simultaneously also works through the partial vacuumizing and sideways movement of one or other of the front suction cup 21 (24) and the rear suction cup 23 (26): this holding at a single point of the flap in question makes it possible to adjust the angle formed between the edge of this flap and the axis X-X' provided that this holding point of the flap by the suction cup is not positioned at the middle of the length (along the axis X-X' of the folder-gluer).

In this case, not shown, where the folded blank 10 has both an inadmissible gap and an inadmissible paralleling fault, the invention enables both anomalies to be addressed and corrected. In practice, the gap is corrected first through the sideways movement of the two suction cups in each pair (right and left), the four suction cups 21, 23, 24 and 26 being engaged with the right- and left-hand flaps 17, 18, as explained above with reference to FIG. 7. Aspiration of one of the two suction cups in each pair is then stopped to correct the fishtailing, as set out above in relation to FIGS. 8 and 9.

The correction means include a pair of right-hand suction cups 21, 23 and a pair of left-hand suction cups 24, 26 (see FIGS. 10A to 13 for the upper part of the correction device).

Equally, for each pair of suction cups, a first suction cup 21 (24) is located at the front and a second suction cup 23 (26) is located at the rear. Furthermore, the vacuumization of the first suction cup 21 (24) is controlled independently from the vacuumization of the second suction cup 23 (26).

To facilitate assembly and control, the two suction cups 21, 23 in the pair of right-hand suction cups are assembled on a right-hand supporting element 31 making it possible to simultaneously move both suction cups 21, 23, and both suction cups 24, 26 in the pair of left-hand suction cups are assembled on a left-hand supporting element 32 making it possible to simultaneously move both suction cups 24, 26. In particular, in order to ensure the correction as described above, the simultaneous movement of the two suction cups in each pair is done in a transverse direction (orthogonal to the direction of forward movement A) and vertically.

Furthermore, as shown in FIGS. 10A and B and 11A and B, in order to follow the travel of the blank 10 in the direction of forward movement A while the correction is being made by the suction cups 21, 23, 24, 26, the right-hand supporting element 31 (left-hand supporting element 32) is assembled using a right-hand bracket 33 (left-hand bracket 34) on the rod 35 (36) of a right-hand linear motor 37 (left-hand linear motor 38). A first position (see FIGS. 10A and 11A) corresponds to the idle position awaiting the arrival of a new blank. A second position (see FIGS. 10B and 11B) corresponds to the end-of-travel position when the blank has been folded, glued and possibly corrected.

The compression module 40 feeds air in a partial vacuum to the right-hand suction cups 21, 23 via a right-hand pipe 41 and feeds air in a partial vacuum to the left-hand suction cups 24, 26 via a left-hand pipe 42 (FIGS. 10A and B and 11A and B).

Optical detection means (not shown) are preferably used to check the position of the right-hand edge 13 and of the left-hand edge 14 after folding of the right-hand flap 17 and of the left-hand flap 18. For example, optical detection as described in document EP 0937573 is used.

These detection means measure the gap between the right-hand edge 13 and the left-hand edge 14 after folding of the right-hand flap 17 and of the left-hand flap 18, at several positions along the longitudinal direction. In this way, calculation means are used to compare each of these measured values with the reference gap, with a predetermined value Gréf, and the need for a correction is determined. In this case, the correction required to bring the blank within the admissible deviation range is calculated.

Numerous different cases are possible, such as a correction of the left-hand flap 18 only, of the right-hand flap 17 only, of the left-hand flap 18 and the right-hand flap 17 simultaneously, and, for the flap or flaps, using both suction cups in the pair (right or left) in question (gap only), a single suction cup in the pair (right or left) in question (fishtailing only), both suction cups and then a single suction cup in the pair (right or left) in question (gap and fishtailing).

By way of example, the right-hand supporting element 31 and the left-hand supporting element 32 have a longitudinal travel (along the axis X-X' of the folder-gluer) of 200 mm thanks to the linear motors 37 and 38. This longitudinal travel makes it possible to follow the blank 10 during a portion of the forward movement of same while performing the correction during the forward movement in the direction of forward movement A. Also by way of example, the right-hand supporting element 31 and the left-hand supporting element 32 have a transverse travel (in the direction orthogonal to the axis X-X' of the folder-gluer) of between 10 mm and 30 mm. This transverse travel is sufficient to correct the anomalies found in most cases relating to blanks of maximum size, for example 1100 mm by 1700 mm.

Pressing means used to create a pressing contact between the right-hand flap 17 and the left-hand flap 18 in the overlapping portion.

The lower portion of the correction device completes the elements used to enable the forward movement of the blank in the longitudinal direction using means for fixing the central flap 19 (see FIGS. 11A, 11B, 13, 14, 15, 16A, 16B, 17A and 17B). The elements enabling the forward movement of the blank 10 are endless belts 60, three of which can be seen in FIGS. 16A, 16B, 17A and 17B, arranged in parallel with one another beneath the suction cups 21, 23, 24 and 26. These fixing means are intended to hold the blank 10 at the central flap 19 of same, preventing same from rising or in particular moving laterally. If the blank were not held by the central flap 19 of same, the position of the right-hand flap 17 and/or of the left-hand flap 18 could not be corrected efficiently and precisely.

As shown in FIGS. 13 to 17, one embodiment of these means 70 for fixing the central flap 19 uses, as means for gripping the central flap 19, vacuum-induced negative pressing of the lower face of the central flap 19. Thus, the partial air vacuumization enables the central flap 19 to be held from below by aspiration as long as the vacuum is maintained. More specifically, the fixing means/flap fixer 70 include at least one boom 71 fitted with nozzles 72 oriented upwards that are able to create a vacuum. These nozzles 72 output onto a supporting plate 75 on which the blank 10 rests, while being driven by the belts 60. In the case shown, two booms 71 are arranged along either one of the external belts 60. For this purpose, the nozzles 72 act as suction cups by suctioning the lower face of the central flap 19 downwards when they are fed with air in a partial vacuum. To do so, a pressing module 73 provides the booms 71 with air in a partial vacuum via the pipes 74.

The boom 71 is assembled (FIGS. 13 to 17B) on a linear motor 80 accompanying the blank 10 along the travel of same in the longitudinal direction of the folder-gluer machine. Thus, to grip the central flap 19 via the lower face of same and to fix same vertically and also transversely in relation to the folder-gluer, the vacuum in the booms 71 is activated, as a result of which each nozzle 72 engages a surface of the lower face of the central flap 19, thereby enabling correction of the right-hand flap 17 and/or of the left-hand flap 18.

For easy and quick starting, the linear motor 80 is placed along the conveyance means that move the blank forwards in the longitudinal direction of the folder-gluer. In the embodiment illustrated, as shown in FIGS. 16A and 16B, these conveyance means are endless belts 60. Advantageously, three endless belts 60 are arranged across the width of the module of the folder-gluer and a boom 71 is assembled alongside and outside the two outside belts. In a variant not shown, a boom 71 is assembled between each pair of belts 60. As such, the blanks 10 are driven by the belts 60 and pressed downwards when the booms 71 are vacuumized.

The linear motors 80 accompany the longitudinal travel of the blank 10 in all cases, regardless of whether a correction is performed. Furthermore, the linear motors 80 are retracted and returned to their initial position soon after the blank 10 leaves the correction device and before arrival of the following blank 10 in the correction device.

Advantageously, the correction means, i.e. the suction cups 21, 23, 24, 26, and the fixing means, i.e. the booms 71, can move in the longitudinal direction (X-X') of the folder-gluer machine at the same speed as the blank 10 during the longitudinal travel of same. In practice, the motor controlling the longitudinal travel of the right-hand supporting element 31 and of the left-hand supporting element 32 is synchronized with the motor controlling the linear motors 80 bearing the suction nozzles 72.

Preferably, gluing is performed, for example, by glue applicator/gluing means 8, before folding of the right-hand flap 17 and of the left-hand flap 18. It is nonetheless essential that the glue is prevented from setting in the overlapping portion between the right-hand flap 17 and the front left-hand flap 18 before and during the positional check (i.e. during steps d), e)) and during any positional correction performed (step f)). For this purpose, according to an advantageous arrangement illustrated partially in FIG. 13, the right-hand flap is prevented from touching the left-hand flap by an element 90 inserted between the right-hand flap 17 and the left-hand flap 18, and before step g) the element 90 is removed and pressing contact is made between the glue, the right-hand flap 17 and the left-hand flap 18 in the overlapping portion, preferably until the glue sets.

In the machine, the correction device preferably also includes an element 90 that can be inserted between the right-hand flap and the left-hand flap before same is folded, and that can be removed before the correction. FIG. 13 partially shows this element 90, which may be in the form of a rod attached by the rear end of same from the top, enabling the blank to pass just beneath the element 90. In this embodiment, the folding and correction of the blank are carried out as the blank 10 is moving forwards. When folding the right-hand flap 17 and the left-hand flap 18, and during the positional check and any correction made, the right-hand flap 17 and the left-hand flap 18 are above the rod, which is in turn above the central flap 19. Following correction, and while the pressure rollers are bearing downwards, the more advanced position of the blank 10 releases the rod, which comes away from the blank, as a result of which the contact between the right-hand flap 17, the left-hand flap 18 and the central flap 19 is ensured to enable the glue to set.

In another embodiment, this element 90 can be removed. The position of the right-hand flap 18 and of the left-hand flap 17 in relation to the central flap 19 is corrected quickly enough to enable this correction to be made before the glue sets.

The present invention is not limited to the embodiments described and illustrated. Numerous modifications can be made without thereby moving outside the scope of the claims. A folder-gluer may also be a folder-gluer unit, assembled for example in an on-line machine, downstream of a flexo press and of a rotary die-cutter.

The invention claimed is:

1. A correction device for correcting the folded position of a blank in a folder-gluer, the blank being conveyed by a conveyor belt in a longitudinal direction through the folder-gluer, the blank having been folded in the folder-gluer from a substantially flat blank, the blank having a right-hand edge, a left-hand edge, a front edge, a rear edge, a right-hand longitudinal crease and a left-hand longitudinal crease, the right-hand longitudinal crease and the left-hand longitudinal crease delimiting, with the right-hand edge and the left-hand edge, at least three flaps in a row including a right-hand flap, a central flap and a left-hand flap; the blank moving through the folder-gluer having been being processed by:

a glue applicator configured to apply glue to one of a zone of the right-hand flap adjacent to the right-hand edge and a zone of the left-hand flap adjacent to the left-hand edge, such that the glue is present in an overlapping portion between the right-hand flap and the left-hand flap;

a flap folder configured and operable for folding the right-hand flap and the left-hand flap over the central flap;

a position checker configured to check, after the folding of the substantially flat blank, a relative position between the right-hand edge and the left-hand edge in the transverse left-right direction of a folded right-hand flap and a folded left-hand flap of the folded blank, and configured to detect at least one of a paralleling fault or a gap between the right-hand edge and the left-hand edge of the folded and glued right-hand and left-hand flaps of the folded blank;

wherein the correction device comprises:

a flap fixer configured to fix the central flap, the flap fixer comprising at least one boom fitted with nozzles that are oriented upwards and are configured to apply vacuum-induced negative pressure to a lower face of the central flap of the blank, a flap position correction device configured to correct, when the at least one of the paralleling fault or the gap is detected, the relative position of at least one of the left-hand flap and the right-hand flap; the flap correction device comprising:

at least a right-hand suction cup;

at least a left-hand suction cup;

the at least one right-hand suction cup is configured to hold the right-hand flap, and the at least one left-hand suction cup is configured to hold the left-hand flap, the suction cups being arranged downwards and configured to move vertically and transversely and to be vacuumized, wherein as the blank is being conveyed by the conveyor belt in the longitudinal direction, the correction device and the flap fixer are configured to advance in the longitudinal direction at the same speed as the blank during the longitudinal travel of the at least one boom.

2. A device according to claim 1, wherein the correction device includes a pair of first and second right-hand suction cups and a pair of first and second left-hand suction cups.

3. A device according to claim 2, wherein each pair of right-hand suction cups and each pair of left-hand suction cups includes:

a first suction cup positioned toward the front, and a second suction cup positioned toward the rear of the respective flaps, and wherein the vacuumization of the first suction cup is controlled independently from the vacuumization of the second suction cup.

4. A device according to claim 2, further comprising:

a right-hand supporting element supporting the two suction cups in the pair of right-hand suction cups, and the right-hand supporting element configured to move simultaneously both of the right-hand suction cups, and a left-hand supporting element supporting the two suction cups in the pair of left-hand suction cups, and the left-hand supporting element configured to move simultaneously both left-hand suction cups.

5. A device according to claim 1, further comprising an element inserted between the right-hand flap and the left-hand flap before folding the flaps, and the element is withdrawable following the correction by the correction device.

6. A device according to claim 1, wherein the boom is provided on a linear motor accompanying the blank along travel of the blank, and the boom is configured to house the vacuum of the nozzles activated when a correction is made after the glue is applied.

7. A folder-gluer machine fitted comprising the device for correcting the folded position of the blank according to claim 1.

8. The folder-gluer of claim 7, wherein the position checker includes an optical detector.

* * * * *